US006915615B2

(12) United States Patent
Won

(10) Patent No.: US 6,915,615 B2
(45) Date of Patent: Jul. 12, 2005

(54) PRESTRESSED COMPOSITE TRUSS GIRDER AND CONSTRUCTION METHOD OF THE SAME

(76) Inventor: Dae Yon Won, #105-1404, Poeun Apt., Wanggok-dong, Uiwang-Si, 437-741 Kyunggi-do (KR)

( * ) Notice: Subject to any disclaimer, the term of this patent is extended or adjusted under 35 U.S.C. 154(b) by 83 days.

(21) Appl. No.: 10/297,779

(22) PCT Filed: Feb. 28, 2002

(86) PCT No.: PCT/KR02/00352

§ 371 (c)(1),
(2), (4) Date: Dec. 9, 2002

(87) PCT Pub. No.: WO02/090660

PCT Pub. Date: Nov. 14, 2002

(65) Prior Publication Data

US 2003/0182883 A1 Oct. 2, 2003

(51) Int. Cl.[7] ..... E04C 3/30

(52) U.S. Cl. ..... 52/720.1; 52/690; 52/693; 52/745.14; 52/334

(58) Field of Search ..... 52/690, 334, 223.8, 52/223.6, 602, 693, 745.19, 745.14, 634, 636, 414; 264/138, 220, 228, 229

(56) References Cited

U.S. PATENT DOCUMENTS

| | | | | | |
|---|---|---|---|---|---|
| 3,600,868 | A | * | 8/1971 | Wilson et al. | 52/334 |
| 4,513,465 | A | * | 4/1985 | Schambeck | 14/74.5 |
| 4,642,830 | A | * | 2/1987 | Richard | 14/4 |
| 5,175,968 | A | * | 1/1993 | Saucke | 52/223.8 |
| 5,218,801 | A | * | 6/1993 | Hereford | 52/223.9 |
| 5,337,531 | A | * | 8/1994 | Thompson et al. | 52/640 |
| 5,560,176 | A | * | 10/1996 | Levo | 52/724.1 |
| 5,655,349 | A | * | 8/1997 | Ghali et al. | 52/724.1 |
| 5,671,573 | A | * | 9/1997 | Tadros et al. | 52/223.8 |
| 5,978,997 | A | * | 11/1999 | Grossman | 14/73 |
| 6,105,321 | A | * | 8/2000 | KarisAllen et al. | 52/223.8 |
| 6,145,270 | A | * | 11/2000 | Hillman | 52/731.1 |
| 6,161,352 | A | * | 12/2000 | Frohlich | 52/334 |
| 6,170,209 | B1 | * | 1/2001 | Dagher et al. | 52/223.1 |
| 6,467,223 | B1 | * | 10/2002 | Christley | 52/143 |

FOREIGN PATENT DOCUMENTS

| | | |
|---|---|---|
| DE | 3322951 | 1/1985 |
| DE | 4141331 | 6/1993 |
| EP | 0 242 238 | 10/1987 |
| GB | 2 281 572 | 3/1995 |
| JP | 56-130007 | 10/1981 |
| JP | 61-229002 | 10/1986 |
| JP | 1-290855 | 11/1989 |
| NL | 7115625 | 5/1973 |

* cited by examiner

*Primary Examiner*—Peter M. Cuomo
*Assistant Examiner*—Erika Garrett
(74) *Attorney, Agent, or Firm*—Jones Day

(57) ABSTRACT

The present invention relates to prestressed composite truss girder and construction method of the same. The prestressed composite truss girder of the present invention comprises a concrete bottom plate having structure of composite truss; a lower-chord member being composed of prestressed concrete wherein prestress is induced to resist against the elongation strength generated when composing and not composing and to reduce the droop occurred at the state of composition and having perpendicular and horizontal cross-section of certain shape and certain length; web members wherein vertical chords and diagnal chords composed of rolled steel to upper plate of said lower-chord member; and upper-chord member combined with said web members along the longitudinal direction of said lower-chord member to resist against the compressive force generated before said concrete bottom plate being composed.

5 Claims, 26 Drawing Sheets

PRESTRESSED COMPOSITE TRUSS GIRDER AND CONSTRUCTION METHOD OF THE SAME

BACKGROUND OF THE INVENTION (a) Field of the Invention

The present invention relates to a prestressed composite truss girder and construction method of the same. More particularly, it relates to a prestressed composite truss girder made by combining lower-chord member composed of prestressed concrete structure with web member composed of rolled steel and upper-chord member composed of structural steel plate, and to construction method of the same.

(b) Description of the Related Art

Generally, the composite girders are composed of precast beam which is manufactured beforehand at a factory or a manufactory and slab concrete combined with said beam, and the bending stress and the shear stress occur when they are subjected to the external loads. In such composite girders, concrete that has strong resistance against compression is used for slab corresponding to the compression region, and steel or prestressed concrete that are highly resistant against tensile and shear stress is used for the precast beam which are mainly subjected to tensile and shear stresses.

Thus, composite girders which are applied at varieties of architectures and engineering structures could be classified into 4 sorts, i.e., steel composite girder, steel reinforced concrete(SRC) composite girder, preflex composite girder and prestressed concrete(PSC) composite girder according to the used material and manufacturing method. Among them, the steel composite girder and the SRC composite girder are non-prestressed structure wherein prestress is not introduced to the cross-section of the girder, and the Preflex composite girder and the PSC composite girder are prestressed structure wherein prestress is introduced when preparing the beam. And, these 4 sorts of composite girders have common point in that all the cross-sectional shape of the beam are solid web style.

As shown at FIG. 1, the steel composite girder (10) consists of I-shape steel to resist the bending stress and shear stress generated by dead load of the steel beam and slab concrete before composition, and the tensile stress caused by external loads after composition. The steel composite girder has advantages in that it could be easily constructed because of its light structure, it could have excellent resistance against earthquake, it could have sufficient ductility against destruction, and the period for site-work could be reduced to somewhat extent.

However, the steel composite girder also has disadvantages in that the material cost is high, noise and vibration by moving loads are heavy, and maintenance and repairing cost take so much. Further, because the steel composite girder has relatively weak stiffness, the height of the beam should be sharply increased to satisfy the deflection limitation against dynamic load when the span length exceeds about 40 m on the basis of simply supported structure system. From this reason, the spaces under the girder often cause problems, and the economical efficiency is remarkably lowered because the amount of steel used increases extremely. Moreover, when the composite girder has continuous span, a negative moment occurs at middle support region by the external load. In this case, the tensile stress occurs at slab concrete which is weak in tension and the compressive stress occurs at the steel girder which is weak in compression. As a result, it causes extraordinary increase of the construction cost compared to the simply supported structure, and the serviceability and the durability of the composite girder will be deteriorated by water leakage caused from the crack of the slab concrete.

As shown at FIG. 2, the SRC composite girder (20) is composed of H-beam and encasing reinforced concrete. The SRC girder is mainly used at the railroad bridge which has strong height limitation because it has greater stiffness than the steel composite girder, or at the continuous girder for building structure because the encasing concrete could resist against compressive stress generated by negative moment.

But, the SRC composite girder is more expensive than the reinforced concrete structure due to filled-in steel beam, and-the structural and economical efficiency are suddenly decreased when the span is longer than 30 m because the dead weight of the structure increase rapidly.

As shown at FIG. 3, the Preflex composite girder (30) has the tension flange which is encased high-strength reinforced concrete, and large prestress is introduced to the encasing concrete of the tension flange. The Preflex composite girder has advantages in that the girder depth could be decreased because the tensile stress by dead and live load is compensated by the introduced prestress, the construction is easy because the weight of girder is light, and the lifting work is very safe because the weight center of the girder lies in bottom flange concrete.

But, the Preflex composite girder has disadvantages in that huge equipment is required to manufacture the Preflex beam, and its construction is more complicated than that of the Steel composite girder or the SRC composite girder, and the economical efficiency is low. Further, Preflex composite girder has structural defects in that the crack of encasing concrete may occur because the prestress introduced to the encasing concrete could be drastically decreased by the creep and shrinkage of concrete, as a result, the encasing concrete is on cracking state under working loads. The amount of the introduced prestress remained in the bottom flange concrete highly depend on the construction schedule. Moreover, if the span length is longer than 50 m, there is a buckling problem of steel beam when introducing preflexing load, and the economical efficiency is remarkably decreased because the amount of steel used and the construction cost for manufacturing the beam itself sharply increases.

As shown at FIG. 4, said PSC composite girder (40) has a structure wherein prestress is introduced to the concrete using high-strength prestressing steel for the purpose of offsetting the tensile stress arose in the cross-section. Said PSC composite girder has advantages in that the price of material is low, the noise is small, and the maintenance cost is low because the main material is concrete, and the displacement is small because the stiffness of the member is great.

But, the PCS composite girder has disadvantages in that its dead weight is heavy, and the construction process is complicated, and the quality control for concrete is difficult. Especially, after applying the dead load and prestressing load, it is most desirable that the distribution of stress induced to the PCS beam is approach the allowable compression stress at the lower chord of the beam and near the allowable tensile stress at the upper chord of the beam, respectively. However, the tensile stress increases rapidly due to it's heavy dead weight as the span length increases, so the more the prestressing should be introduced, and the intensity of the introduced prestress is limited by the geometric properties because the total stress at upper fiber of the cross-section exceeds the allowable tensile stress when the prestress is large. As a result from above facts, sufficient prestress couldn't be introduced to the lower fiber of cross-section, so the beam having large stiffness to resist the tensile stress generated by dead weight of the beam and by live load, namely the high beam is required, however, this causes increase of the dead weight of the beam. By the reasons above-mentioned, the applicable span length of the PSC composite girder is restricted within maximum 40 m based on the simply supported structure system. Further, the PSC composite girder has problem in that huge equipment is required for transportation and construction because lifting of the precast beam using general sized crane is impossible due to the dead weight when the span length is larger than 30 m.

Thus, though there are somewhat differences according to the structural type, the span length of the beam applicable for the conventional composite girders is restricted within maximum 50 m based on the simply supported structure system by the reason of the structural efficiency, the economical efficiency and of the construction efficiency.

Moreover, the beams used for the conventional composite girder is accompanied with many difficulties for manufacturing a certain curved structure of the plane or of the cross-section because all of them are unified solid cross-sectional structure. Of course, it is possible that manufacturing the member having curved structure for the steel beam, but it is not competitive compared with the member having the other structural type because of steep increment of manufacturing cost and abrupt descent of construction efficiency due to it. That is, an expensive steel or concrete box-type girder is more commonly used when the object structure is a curved bridge or curved structure that could not be corresponded with a straight-line type beam than open-type composite girder.

SUMMARY OF THE INVENTION

It is an object of the present invention is to provide a prestressed composite truss girder which could extend span length more than 70 m based on simply supported structure system, could efficiently resist the tensile stresses generated by external loads including dead weight, could maximize the efficiency of material use, could be applied to arbitrary-type curved structure, and could cut short the construction cost more drastically than that of the conventional composite girders.

Another object of the present invention is to provide construction method of the same.

To achieve the object above mentioned, a prestressed composite truss girder according to the present invention has a truss structure whereon a slab concrete is composed, and comprises; a lower-chord member composed of prestressed concrete wherein prestress is introduced to resist against tensile stress generated by loads before or after composition of said slab concrete and to reduce the displacement occurred at the state of composition and having perpendicular and horizontal cross-section of certain shape and certain length; web member wherein vertical members and diagonal members composed of rolled steel to resist against the shear stress applied on the composite girder are connected with the upper face of said lower-chord member with regular distance; and upper-chord member connected with said web member along the longitudinal direction of said lower-chord member to resist-against the compressive force generated before said slab concrete is composed.

Further, to achieve another object above mentioned, a construction method of the composite truss girder according to the present invention comprises steps of; (a) forming a prestressed concrete lower chord member having certain length, wherein certain prestress is introduced to the axial direction; (b) connecting alternately the vertical members and the diagonal members composed of structural rolled steel having certain length on the upper face of said lower-chord member; and (c) connecting a planar upper chord member with said vertical members and diagonal members to the longitudinal direction of said lower chord member.

Thus, the present invention has features in that the span length based on simply supported structure system could be extended to more than 70 m, and external loads including dead weight could efficiently be managed, and the efficiency of material use could be maximized. Also, the present invention could be applied to any shape of the structure and could cut short the construction cost considerably.

DETAILED DESCRIPTION OF THE PREFERRED EMBODIMENTS

[Brief Description of the Views]

Figure 7A:
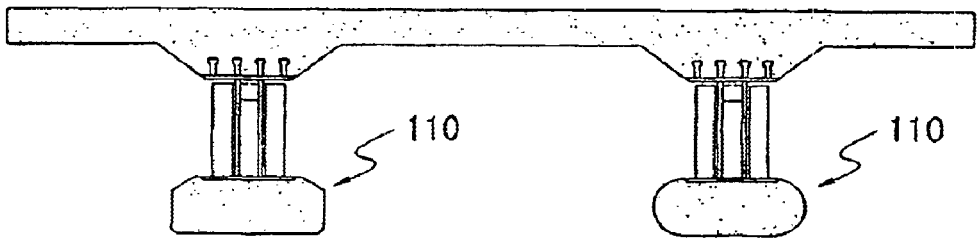
Figure 7B:
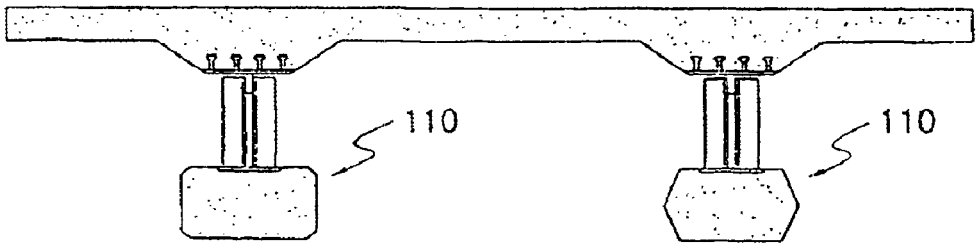
Figure 7C:
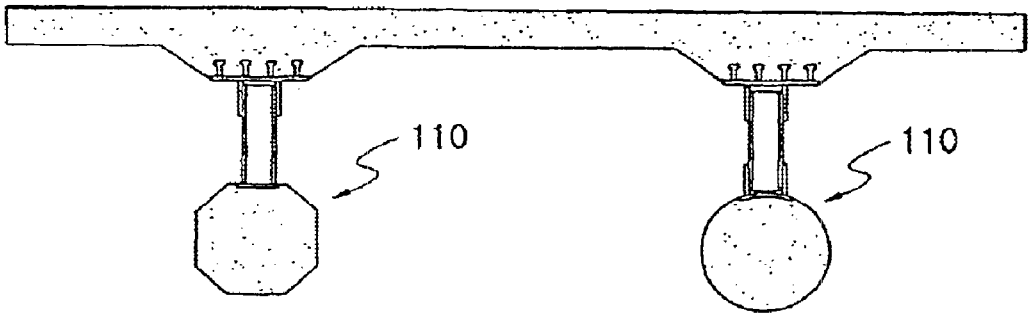

FIG. 7*a* to FIG. 7*c* are cross-sectional schematic views representing the structure of a lower chord member having rectangular, circular and elliptical shape, respectively.

FIG. 8*a* to FIG. 8*d* are cross-sectional schematic views representing the detail of connections between web member and lower chord member.

Figure 9A:
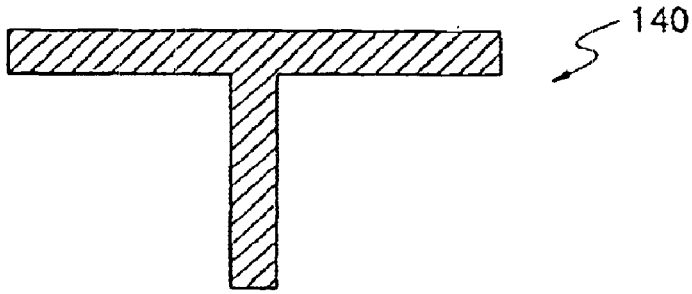
Figure 9B:
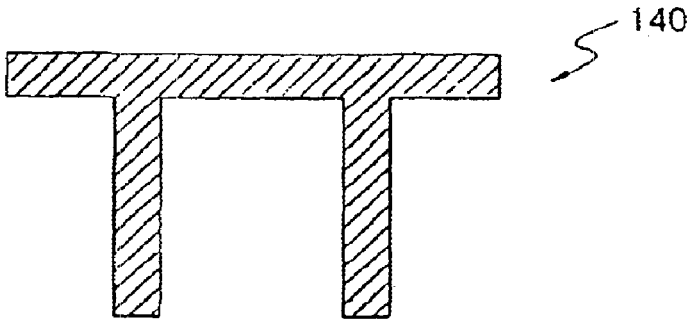

FIG. 9*a* to FIG. 9*b* are cross-sectional schematic views representing the shape of the upper chord member.

Figure 10A:
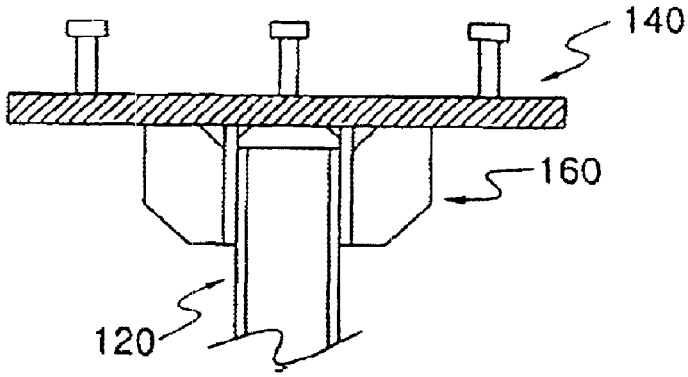
Figure 10B:
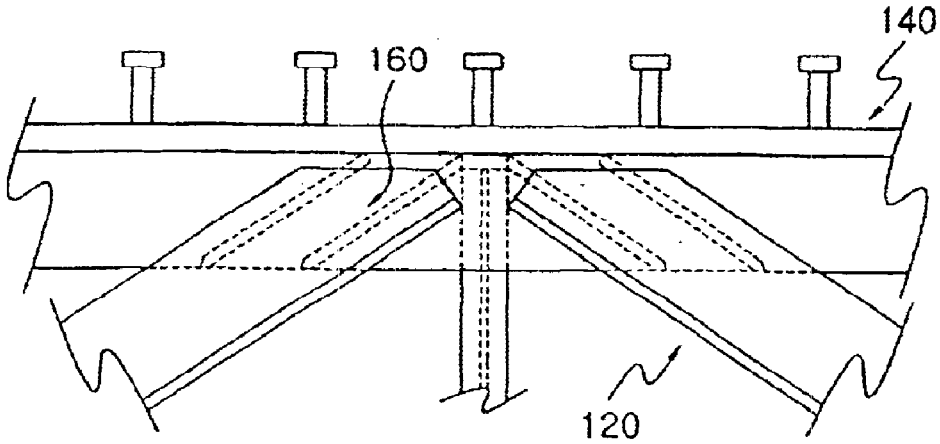

FIG. 10*a* to FIG. 10*b* are cross-sectional schematic views representing the details of weld connections between web member and upper chord member.

Figure 10C:
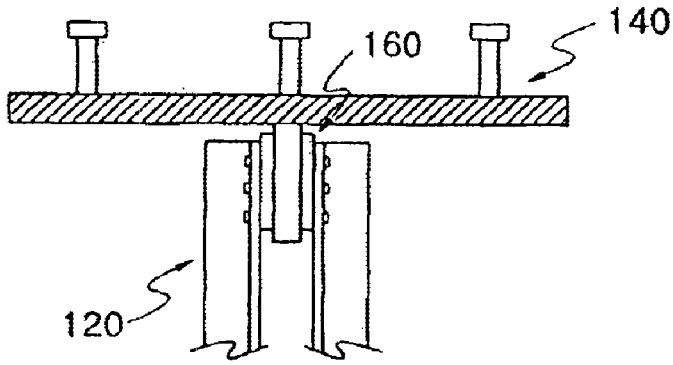
Figure 10D:
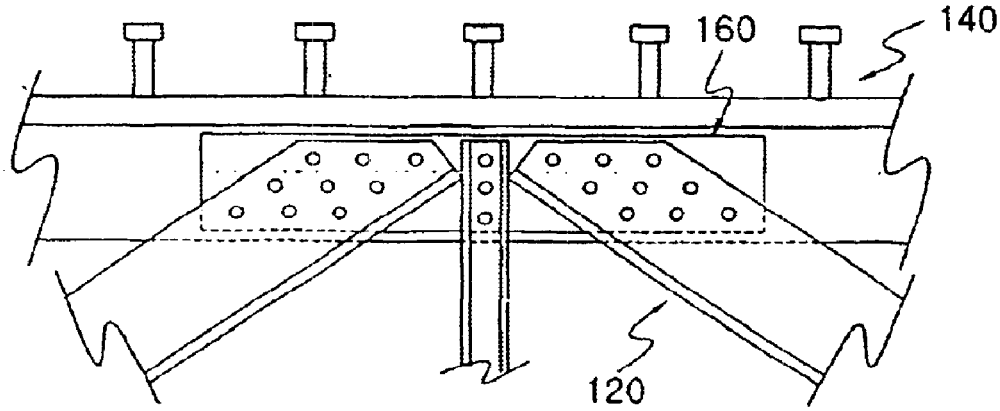

FIG. 10*c* to FIG. 10*d* are cross-sectional schematic views representing the details of bolt connections between web member and upper chord member.

Figure 11:
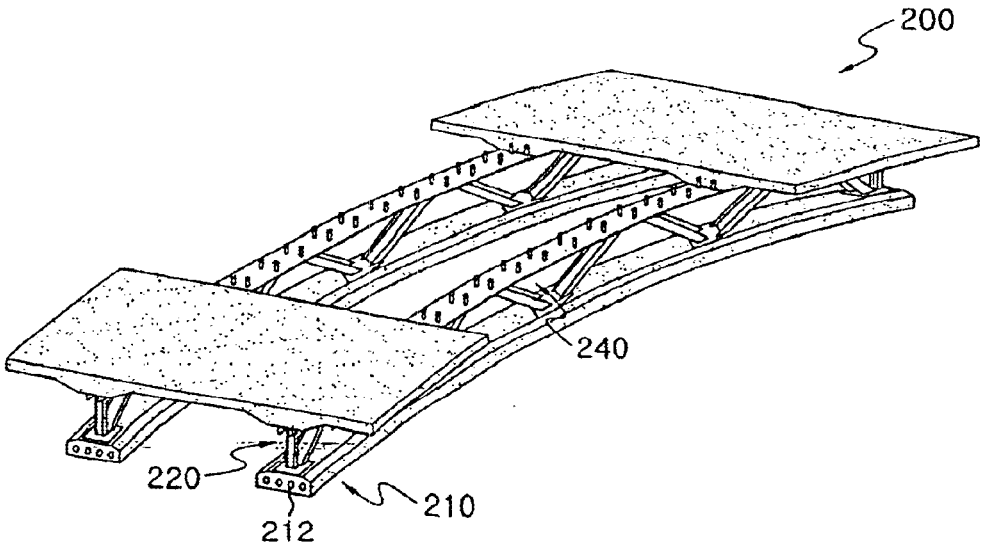

FIG. 11 is a perspective view representing the structure of a prestressed composite truss girder according to the $2^{nd}$ preferred embodiment of the present invention.

Figure 12:
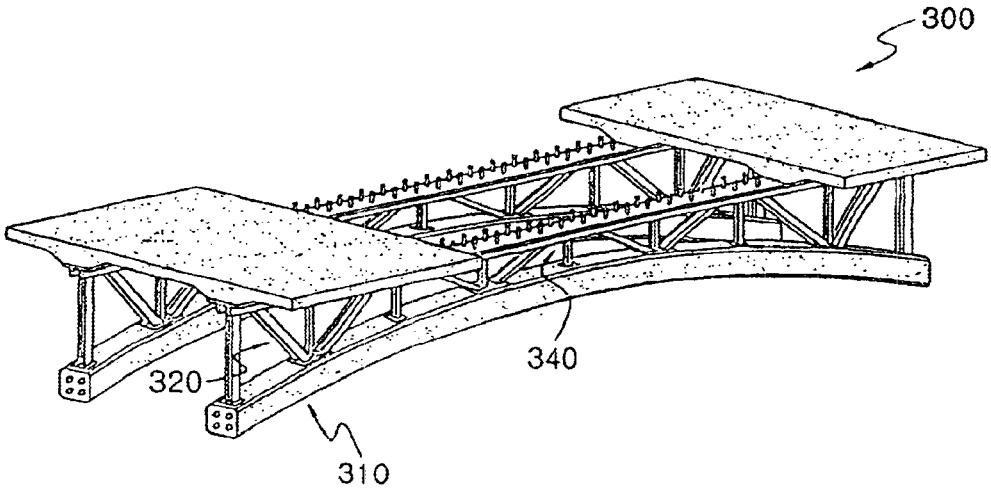

FIG. 12 is a perspective view representing the structure of a prestressed composite truss girder according to the $3^{rd}$ preferred embodiment of the present invention.

Figure 13:
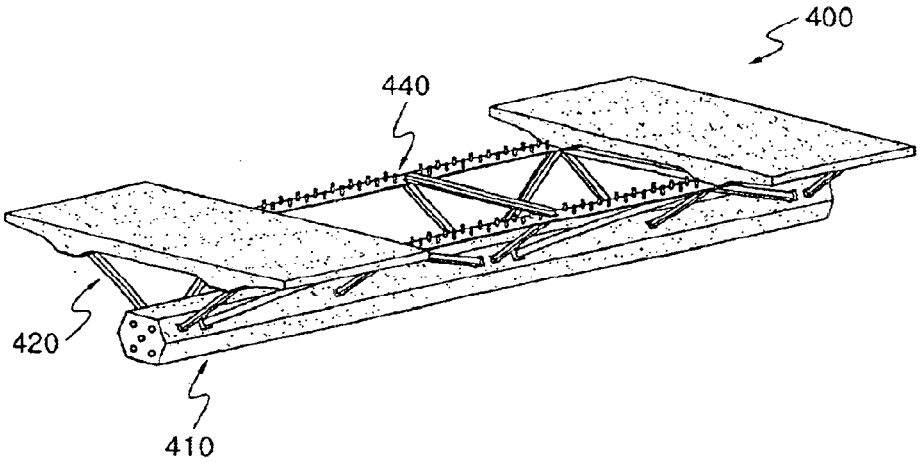

FIG. 13 is a perspective view representing the structure of a prestressed composite truss girder according to the $4^{th}$ preferred embodiment of the present invention.

Figure 14:
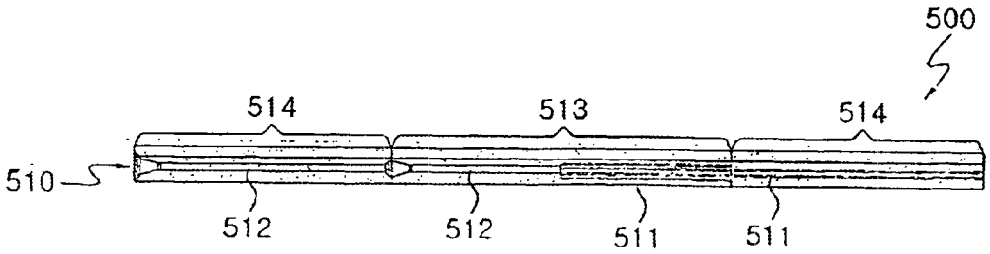

FIG. 14 is a conceptual drawing representing the structure for varying prestressing forces introduced to the lower chord member in the prestressed composite truss girder according to the $5^{th}$ preferred embodiment of the present invention.

Figure 15:
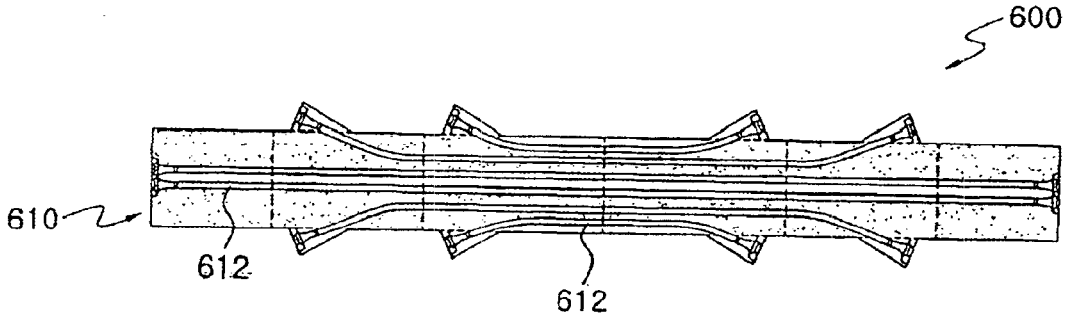

FIG. 15 is a conceptual drawing representing the structure for varying prestressing forces introduced to the lower chord member in the prestressed composite truss girder according to the $6^{th}$ preferred embodiment of the present invention.

Figure 16:
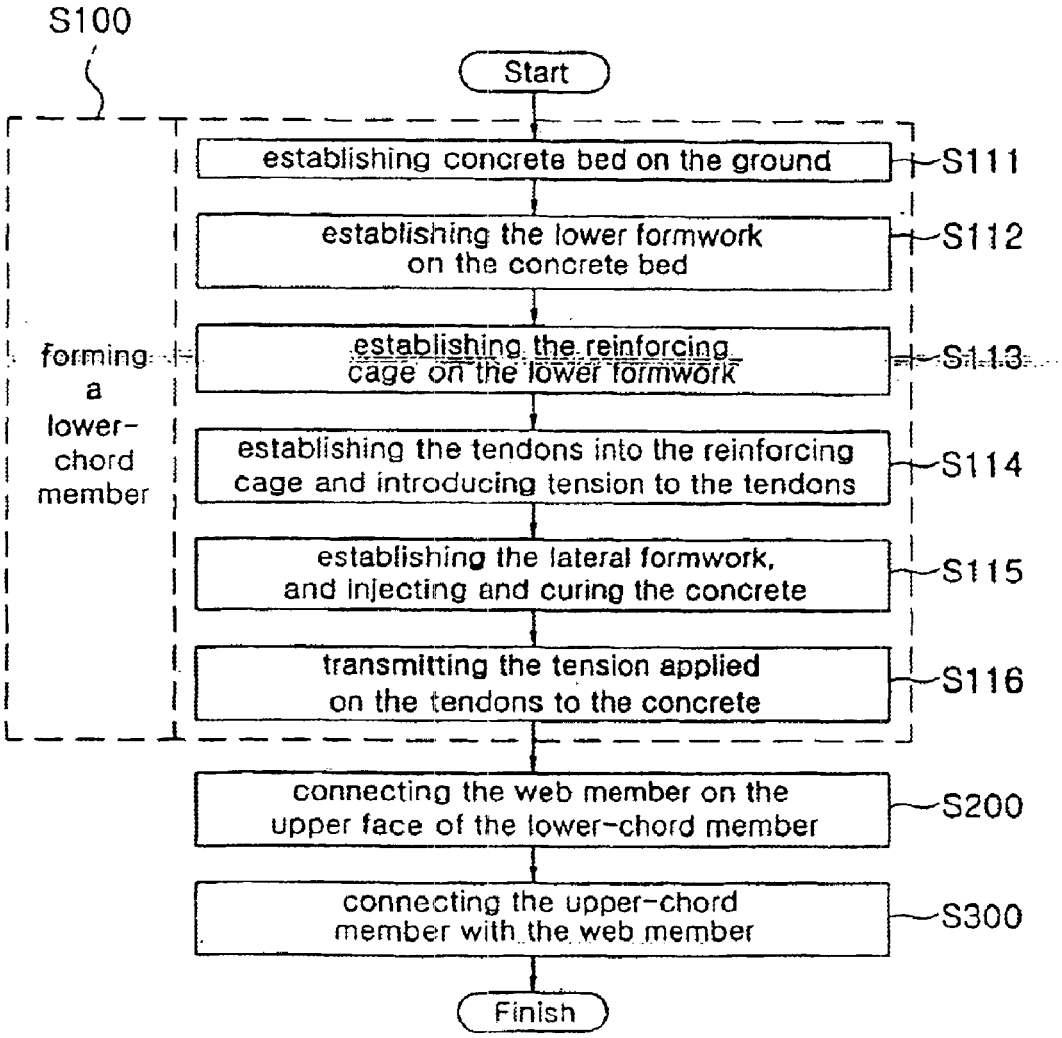

FIG. 16 is a flow chart to explain a construction method of the prestressed composite truss girder according to the $1^{st}$ preferred embodiment of the present invention.

FIG. 17*a* to FIG. 17*l* are brief cross-sectional schematic views to explain the construction method of the prestressed composite truss girder according to the 1st preferred embodiment of the present invention.

Figure 18:
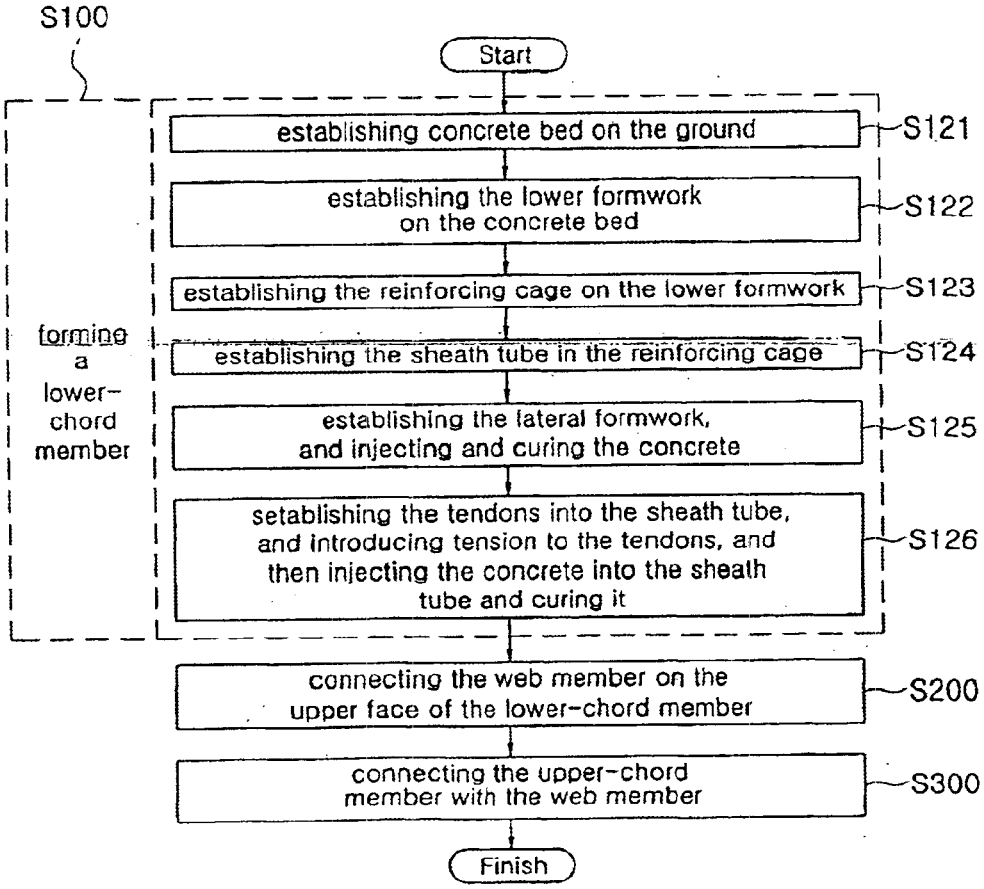

FIG. 18 is a flow chart to explain the construction method of a prestressed composite truss girder according to the 2nd preferred embodiment of the present invention.

FIG. 19*a* to FIG. 19*h* are brief cross-sectional schematic views to explain the construction method of the prestressed composite truss girder according to the 2nd preferred embodiment of the present invention.

Figure 20:
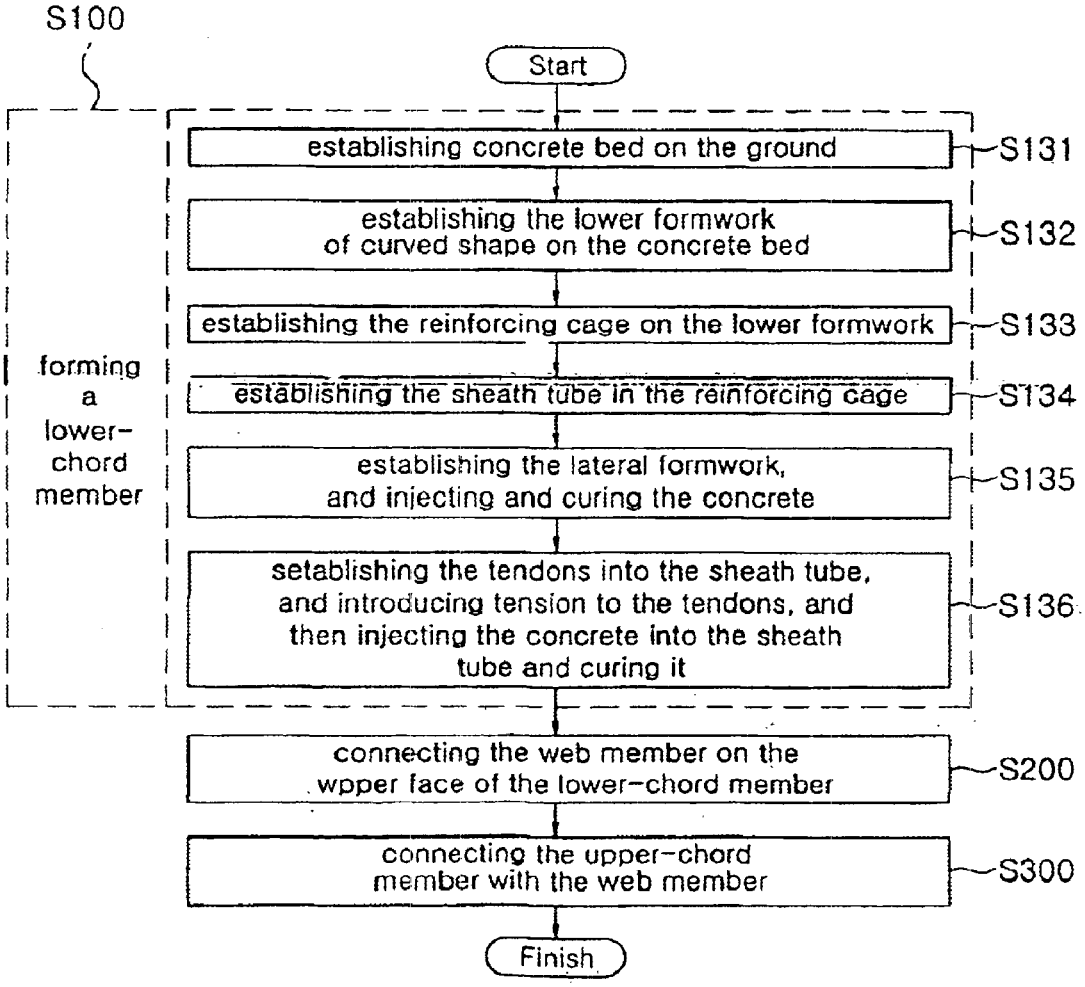

FIG. 20 is a flow chart to explain a construction method of the prestressed composite truss girder according to the 3rd preferred embodiment of the present invention.

Figure 21:
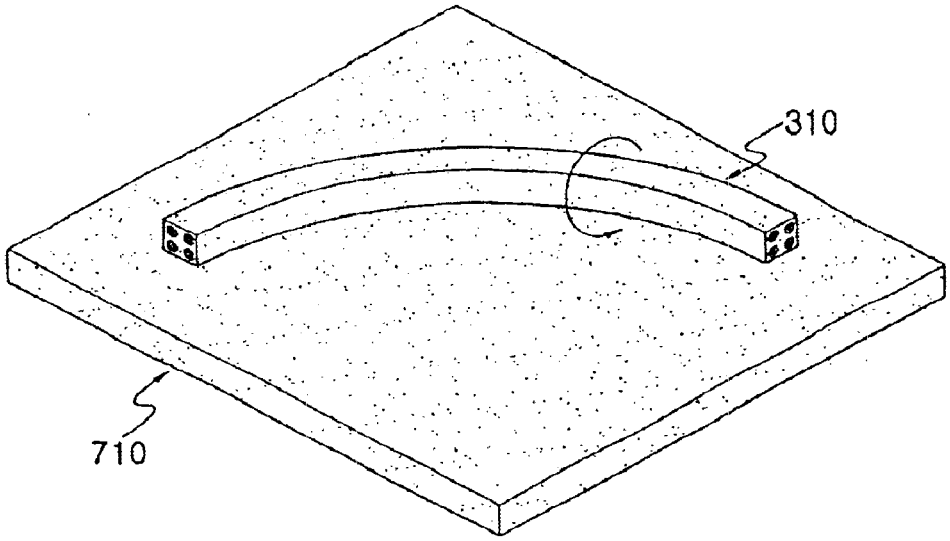

FIG. 21 is a brief perspective view to explain the construction method of the prestressed composite truss girder according to the 3rd preferred embodiment of the present invention.

Embodiment

Hereinafter, the present invention will be described in detail with reference to the preferred embodiments. But, those skilled in the art will appreciate that various modifications and substitutions can be made therein without departing from the spirit and scope of the present invention as set forth in the appended claims. The embodiments of the present invention are provided for illustrating the present invention more completely to those skilled in the art.

Figure 1:
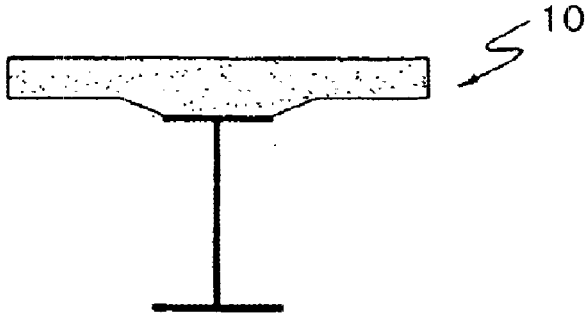
FIG. 1 is a cross-sectional schematic view representing the structure of the conventional steel composite girder.
Figure 2:
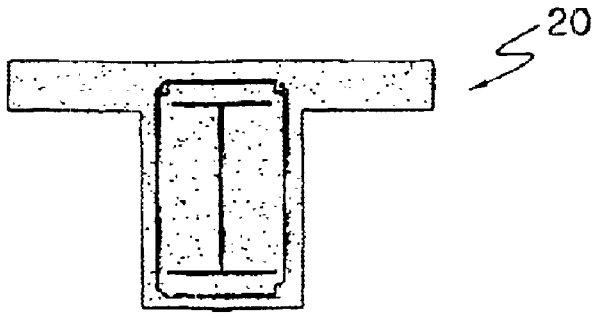
FIG. 2 is a cross-sectional schematic view representing the structure of the conventional SRC composite girder.
Figure 3:
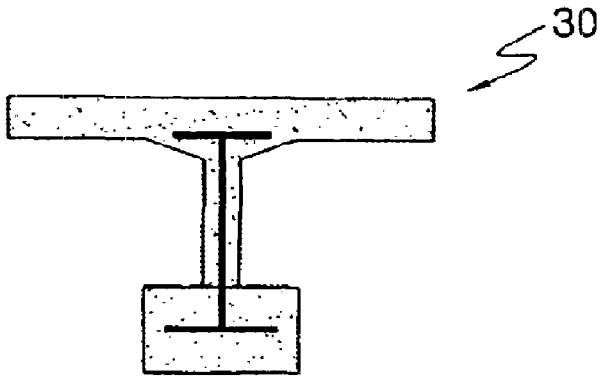
FIG. 3 is a cross-sectional schematic view representing the structure of the conventional Preflex composite girder.
Figure 4:
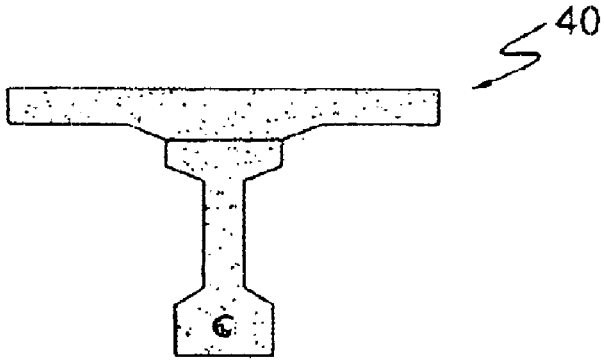
FIG. 4 is a cross-sectional schematic view representing the structure of the conventional PSC composite girder.
Figure 5:
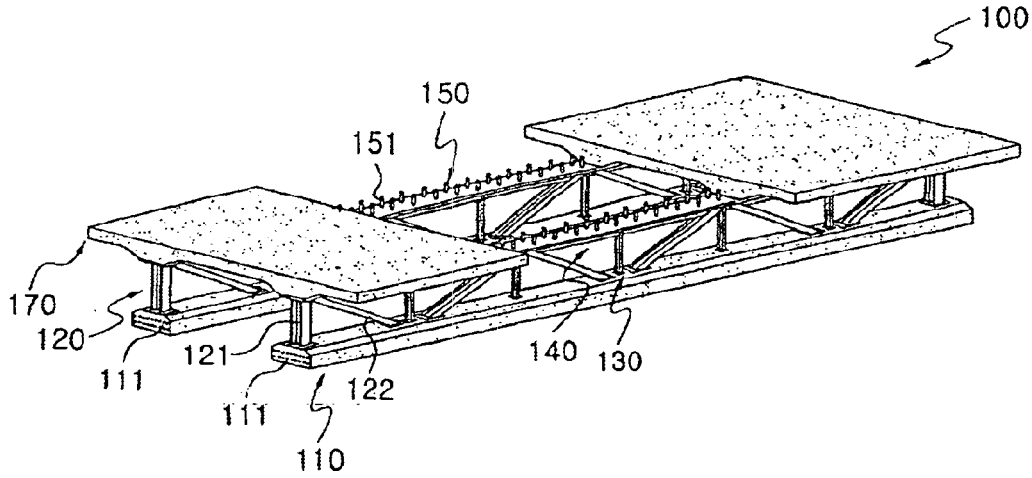
FIG. 5 is a perspective view representing the structure of a prestressed composite truss girder according to the $1^{st}$ preferred embodiment of the present invention.

FIG. 5 is a perspective view representing the structure of a prestressed composite truss girder according to the 1st preferred embodiment of the present invention.

Referring to FIG. 5, a prestressed composite truss girder (100) according to the 1st preferred embodiment of the present invention has truss structure whereon the concrete slab(170) is composed, and comprises; a lower-chord member (110) composed of prestressed concrete wherein prestress is introduced to resist against tensile stress generated when being composed or being not composed and to reduce the displacement occurred at the state of composition and having perpendicular and horizontal cross-section of certain shape and certain length; web member (120) composed of vertical members(121) and diagonal members (122) connected with the upper face of said lower-chord member (110) with regular distance to resist against the shear stress applied on the composite girder; and upper-chord member (140) connected with said web member along the longitudinal direction of said lower-chord member(110) to resist against the compressive force generated before said concrete slab(170) is composed.

Said lower-chord member(110) has a certain cross-sectional shape in longitudinal and transverse directions, and is composed of prestressed concrete wherein a prestress is introduced by the commercial pre-tensioning method or post-tensioning method. As a reference, said pre-tensioning method is a method of adding prestress by making a concrete after tensioning a tendon such as prestressing steel (P. S. steel) at first, and transmitting the tension applied on the tendon to the concrete by bond action between the tendon and the hardened concrete. Further, said post-tensioning method is a method of prestressing the concrete section by tensioning the P. S. steel in the sheath disposed beforehand concrete casting and inserting the grout member to the inside of the sheath after tensioning of P.S. steel.

It is preferable that said lower-chord member (110) has uniform cross-section to the longitudinal direction.

In said lower-chord member (110) a plurality of wire-type tendons (112) wherein a certain tensioning is applied on by said pre-tensioning method is prepared to introduce prestress to the axial direction of the member.

Figure 6:
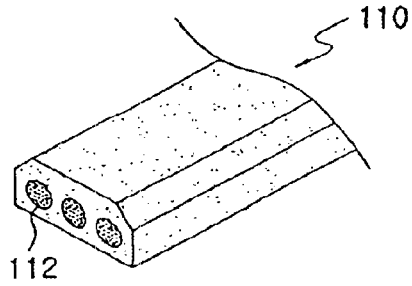
FIG. 6 is a perspective view representing the state that a plurality of wire-type tendons wherein a certain prestress is introduced by post-tensioning method is established to the lower chord member.

As shown at FIG. 6, in said lower-chord member (110) a plurality of tendons (112) composed of multi-strands is prepared to introduce prestress to the axial direction of the member (110) by said post-tensioning method.

As shown at FIG. 7*a* to FIG. 7*c*, said lower-chord member (110) may have one of various cross-sectional shapes, such as elliptical, rectangular, circular or polygonal cross-section.

As shown at FIG. 5, said web member connected with said lower-chord member (110) in a regular interval along the longitudinal direction of said lower-chord member comprises vertical member (121) and diagonal members (122).

As shown at FIG. 5, the present invention comprises the connecting unit (130) placed in upper face of the lower-chord member (110) with a regular distance for connecting web members (121, 122) and lower-chord member (110).

Figure 8A:
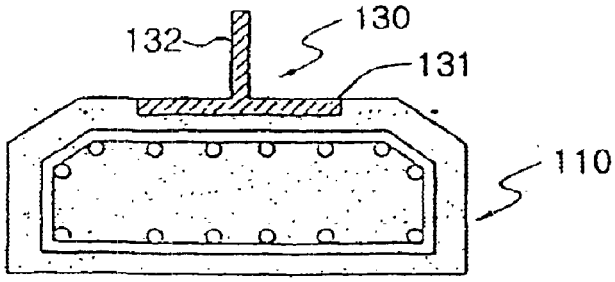

As shown at FIG. 8*a*, said connecting unit (130) comprises connecting plate (131) fixed on the upper face of the lower-chord member (110) and vertical plate (132) welded to the connecting plate (131) to connect the vertical member (121: FIG. 5) and the diagonal member (122: FIG. 5).

Figure 8B:
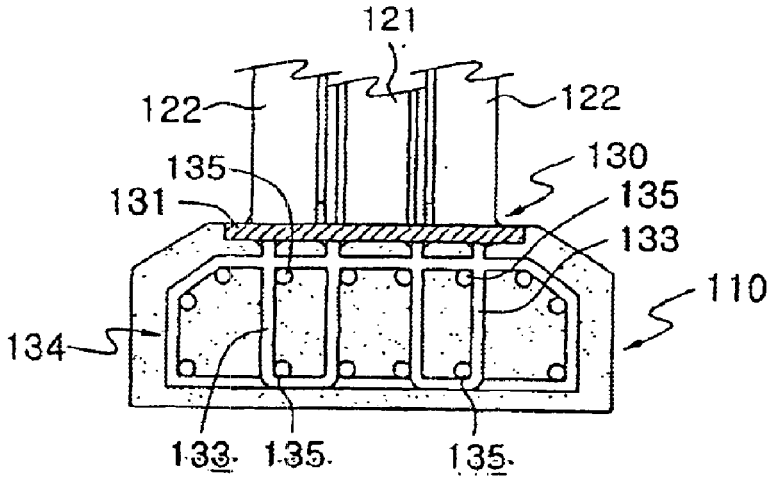
Figure 8C:
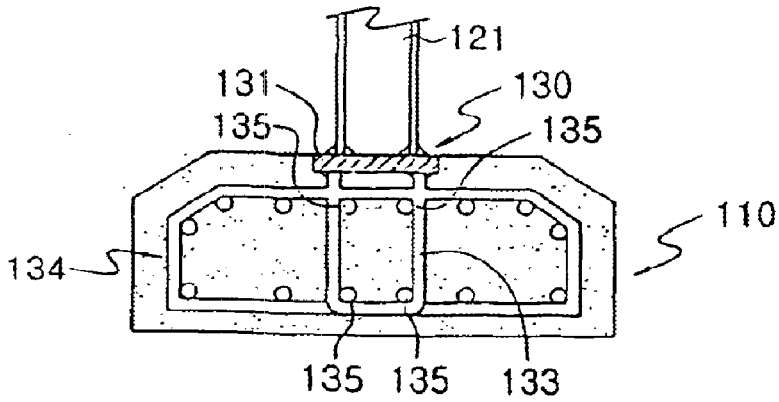

As shown at FIG. 8*b* and FIG. 8*c*, said connecting unit (130) may comprise connecting plate (131) fixed on the upper face of the lower-chord members (110) and connected with the web members (121,122), and stirrup-type reinforcing bars (133) of which at least one is welded on the lower face of the connecting plate (131). Said stirrup-type reinforcing bars (133) are disposed vertically surrounding the horizontal bar (135) of the reinforcing net (134) placed in lower-chord member (110).

Figure 8D:
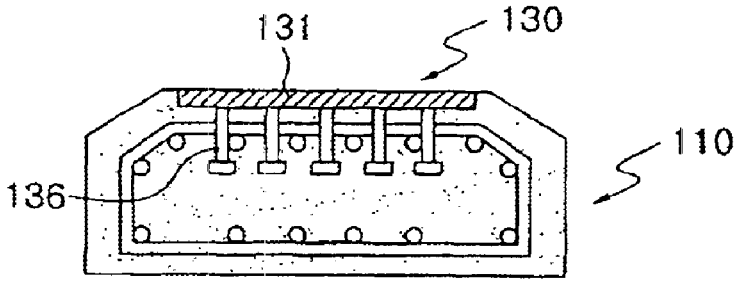

As shown at FIG. 8*d*, said connecting unit (130) for the web member may comprise connecting plate (131) fixed on the upper face of the lower-chord member (110) and connected with the vertical member (121: FIG. 5) and the diagonal member (122: FIG. 5), and a plurality of studs (136) which are welded on the lower face of the connecting plate (131) to be enclosed in the lower-chord member (110).

As shown at FIG. 5, said upper-chord member(140) is a planar member having a linear cross-section and a corresponding length to the length of lower-chord member, and connected by welding or bolting method with the top end of the vertical member (121) and the diagonal members (122) of the web member (120).

As shown at FIG. 9*a*, it is preferable that said upper-chord member (140) has "⊤" shape of its cross-section.

As shown at FIG. 9*b*, said upper-chord member (140) may have "⊤" shape of its cross-section.

As shown at FIG. 5, the present invention further comprises a plurality of shear connectors (150) welded on top surface of upper-chord member continuously at a certain interval along the longitudinal direction to obtain the composition actions between the upper-chord member (140) and the concrete slab (170). As shown at FIG. 10*a* to FIG. 10*d*, planar stiffener (160) established at a certain position of the upper-chord member (140) connected with web member (120) to inhibit the partial stress concentration at the connection part.

As shown at FIG. 5, said shear connector (150) comprises a plurality of stud (151) welded on the upper face of the upper-chord member (140).

As shown at FIGS. 10*a* and 10*b*, said stiffener (160) may be connected perpendicularly by welding on a certain position of the upper-chord member (140) connected with the web member (120) and the upper end of the web member (120).

As shown at FIGS. 10*c* and 10*d*, said stiffener (160) may be connected perpendicularly by bolting on a certain position of the upper-chord member (140) connected with the web member (120) and the upper end of the web member (120).

The prestressed composite truss girder according to the $1^{th}$ preferred embodiment of the present invention could effectively deal with the tensile stress generated by external load because it has the structure to which prestress is introduced to the axial direction of the lower-chord member, could maximize the material efficiency because the intensity of the prestress introduced to the lower-chord member could be increased to the allowable compressive stress, and could extend the applicable span length to more than 70 m based on the simply supported structure system. In addition, it could also effectively be utilized at the composite girder having continuous span without supplementary equipment because the lower-chord member is composed of concrete which has strong resistance against compressive force. Moreover, the span length could be extended by only extending the length of the web member if it is intended to be extended on the condition of same load, because the cross-sectional forces on the lower-chord member and the upper-chord member could be kept up with only extending the length of the web member maintaining the cross-sectional size of the lower-chord member and the upper-chord member, and so the standardization of the product could be easily accomplished.

FIG. 11 is a perspective view representing the structure of a prestressed composite truss girder according to the $2^{nd}$ preferred embodiment of the present invention.

Referring to FIG. 11, the prestressed composite truss girder (200) according to the $2^{nd}$ preferred embodiment of the present invention comprises the lower-chord member (210) and the upper-chord member (240) having a curved cross-section of arbitrary curvature, on the contrary to the $1^{st}$ preferred embodiment. Further, it is preferable that the standard line that links each of the upper ends of the web member (220) in said truss girder (200) is a curved line.

Inside of said lower-chord member (210), a plurality of tendons (212) wherein a certain prestress is introduced by said post-tensioning method is established along the longitudinal direction of the lower-chord member (210) to introduce prestress to the axial direction of the concrete.

It is preferable that said upper-chord member (240) is a curved shape having same curvature of the lower-chord member (210).

Therefore, for the prestressed composite truss girder according to the $2^{nd}$ preferred embodiment of the present invention, the lower-chord member and the upper-chord member which are excellent of their formability is manufactured to fit a certain curve, and the web member composed of structural rolled steel is manufactured in straight line shape, then they are structurally connected by welding or bolt, so the shape of the girder could be manufactured freely to fit a certain curve.

FIG. 12 is a perspective view representing the structure of a prestressed composite truss girder according to the $3^{rd}$ preferred embodiment of the present invention.

Referring to FIG. 12, the prestressed composite truss girder (300) according to the $3^{rd}$ preferred embodiment of the present invention comprises the lower-chord member (310) having a curved cross-section of arbitrary curvature, the upper-chord member (340) having a straight cross-section and web member (320) connected with the upper-chord member (340). Further, it is preferable that the standard line that links each of the upper ends of the web member (320) in said truss girder (300) is a straight line.

FIG. 13 is a perspective view representing the structure of a prestressed composite truss girder according to the $4^{th}$ preferred embodiment of the present invention.

Referring to FIG. 13, the prestressed composite truss girder (400) according to the $4^{th}$ preferred embodiment of the present invention comprises web member (420) established diagonally to a certain angle at two sides of the lower-chord member (410) to the longitudinal direction of the lower-chord member (410) having approximately hexagonal cross-section and the upper-chord member (440) connected with the web member (420).

FIG. 14 is a conceptual drawing to represent the structure for varying the prestressing force in the lower chord member of a prestressed composite truss girder according to the $5^{th}$ preferred embodiment of the present invention.

Referring to FIG. 14, a prestressed composite truss girder according to the $5^{th}$ preferred embodiment of the present invention comprises a variable tendons layout to increase the prestress on the middle part of the lower-chord member (510) and to decrease the prestress as go further from the middle part. As a result, when the girder is applied to the continuous span, the negative moments occurred at the middle support could be managed effectively.

It is preferable that said lower-chord member (510) is divided into approximately 3 parts wherein the intensity of the introduced prestress is different from each other over the whole length.

To realize above fact, said lower-chord member (510) comprises the central area (513) wherein a large amount of tendons (511, 512) are placed and the outer area (514) wherein relatively small amount of tendons in comparison with the central area (513) is placed.

FIG. 15 is a conceptual drawing to represent the structure for varying prestressing force in the lower chord member of a prestressed composite truss girder according to the $6^{th}$ preferred embodiment of the present invention.

Referring to FIG. 15, a prestressed composite truss girder (600) according to the $6^{th}$ preferred embodiment of the present invention, on the contrary to said $5^{th}$ preferred embodiment, comprises a plurality of tendon (612) which is tensioned by post-tensioning method. The amount of tendons is concentrated on the central region of the lower-chord member (610) manufactured beforehand being divided in a certain length, and is decreased the outer region from the central region.

The tendon (612) of said lower-chord member (610) is placed along the axial direction of the lower-chord member (610) to the whole length and is anchored at middle part or both end of the lower-chord member (610).

The details about construction methods of the prestressed composite truss girder according to the preferred embodiment of the present invention composed as above will be now described.

FIG. 16 is a flow chart to explain the construction method of a prestressed composite truss girder according to the $1^{st}$ preferred embodiment of the present invention.

Referring to FIG. 16, the construction method of a prestressed composite truss girder according to the $1^{st}$ preferred embodiment of the present invention comprises the steps of; (S100) forming a prestressed lower-chord member having a certain length, wherein a certain prestress is introduced to the axial direction; (S200) connecting the vertical members and the diagonal members composed of structural rolled steel on the upper plate of the lower-chord member alternately; and (S300) connecting planar upper-chord member with the vertical members and diagonal members along the longitudinal direction of the lower-chord member.

More precisely, the step of forming said lower-chord member (S100) is to introduce the prestress to the concrete of the lower-chord member applying pre-tensioning method, and comprises multiple steps as follows. In the step of (S111), the concrete bed is established on the ground after smoothing the ground of a certain place. In the step of (S112), the lower formwork of linear form having a certain width and length is placed on the H-beam after disposing a plurality of the H-beam in the lattice form on the concrete bed. In the step of (S113), spacers is placed between the reinforcing cage and the upper face of the lower formwork to separate the reinforcing cage composed of horizontal and vertical reinforcing bars with a certain interval along the longitudinal direction of the lower chord member. In the step of (S114), a plurality of the wire-type tendons is placed into the reinforcing cage, then the abutment is established at both ends of the lower-formwork, and the tendons are stressed by oil jack and are anchored to the abutment. In the step of (S115), the concrete is cured for a certain period after setting the lateral formwork to the lateral side of the reinforcing cage and pouring the concrete into the lateral formwork. In the step of (S116), the jacking force applied on the tendons is transmitted to the cured concrete by cutting the tendons at the abutments.

FIG. 17*a* to FIG. 17*l* is a brief cross-sectional schematic view to explain the construction method of the prestressed composite truss girder according to the 1$^{st}$ preferred embodiment of the present invention.

Figure 17A:
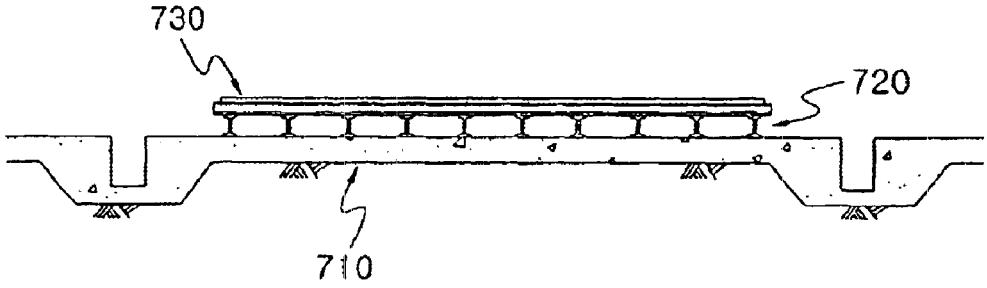

At first, as shown at FIG. 17*a*, the concrete bed (710) is established flatly on a certain place of the ground.

Next, a plurality of H-beam (720) is continuously placed vertically on the upper face of the concrete bed being separated at a certain interval.

Then, a plurality of H-beam (720) is continuously placed horizontally on the H-beam (720) of the vertical direction being separated at a certain interval.

Subsequently, the lower formwork (730) having a certain width and length is established on the H-beam (720) of the vertical direction. Here, the cross-sectional shape of said lower formwork (730) is preferably linear.

Figure 17B:
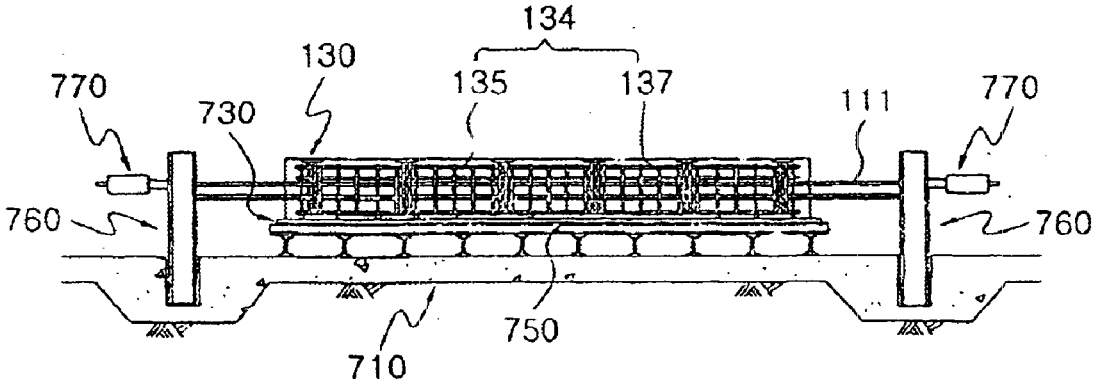
Figure 17C:
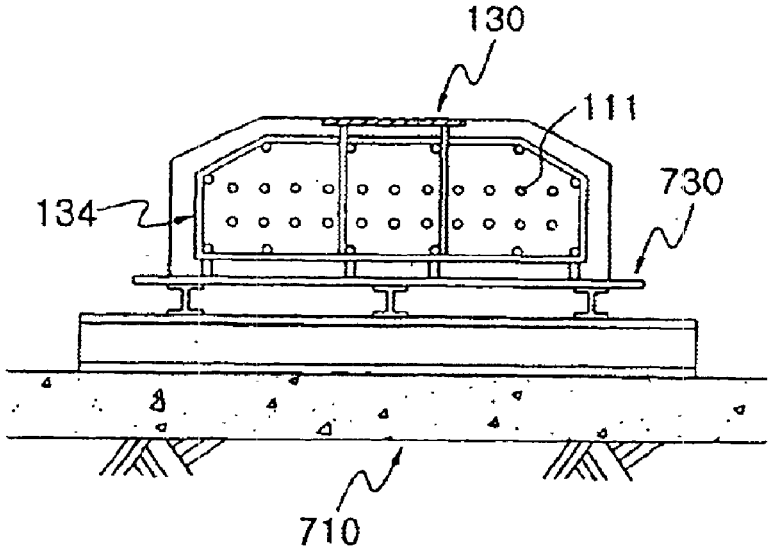

Next, as shown at FIGS. 17*b* and 17*c*, the reinforcing cage (734) wherein the transverse reinforcing bar (135) and the vertical reinforcing bar (137) are connected with each other along the longitudinal direction of the lower formwork (730) is placed on the lower formwork.

Then, the connecting unit (130) for the web member is anchored to the reinforcing cage (134) with a certain distance. As shown at FIG. 8*a*, it is preferable that the connecting plate (131) of the connecting unit (130) for the web member is fixed to the upper face of the reinforcing cage (134) by welding.

Further, as shown at FIGS. 8*b* and 8*c*, the connecting unit (130) for the web member may have the stirrup-type reinforcing bar (133) on the lower face of the connecting plate (131) attached by welding. It is preferable that said stirrup-type reinforcing bar is placed vertically enclosing the transverse reinforcing bar (135) of the reinforcing cage (134).

Furthermore, as shown at FIG. 8*d*, the connecting unit (130) for the web member may have a plurality of studs (136) on the lower face of the connecting plate (131) attached by welding.

Next, as shown at FIG. 17*b* and FIG. 17*c*, the spacer(750) composed of cement mortar is placed with a certain interval between the reinforcing cage (134) and the upper face of the lower formwork (730) to separate the reinforcing cage (134) from the upper face of the lower formwork (730).

Subsequently, after inserting a plurality of wire-type tendons (111) into the reinforcing cage (134), the abutments (760) composed of structural rolled steel are established on the concrete bed (710) separated from the lower formwork (730) at a certain interval.

Next, the tendons are stressed (111) by the oil jack (770) and are anchored to the abutment (760).

Figure 17D:
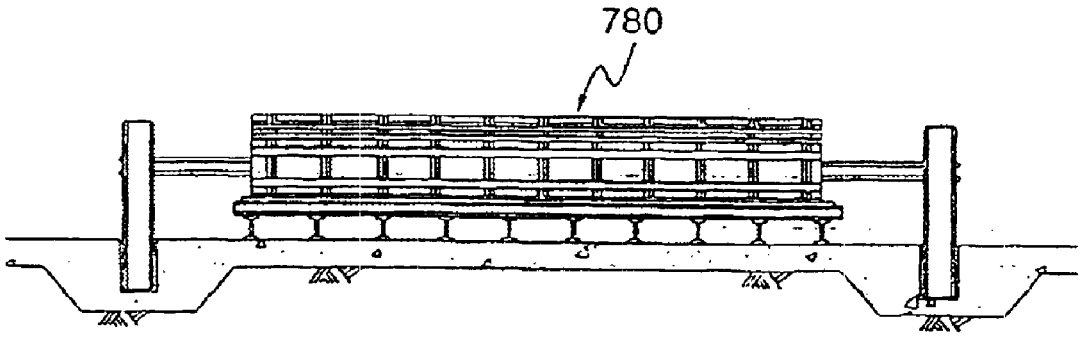
Figure 17E:
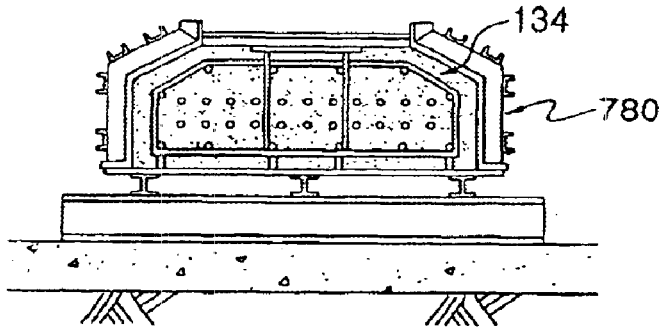

Subsequently, as shown at FIGS. 17*d* and 17*e*, the lateral formwork (780) prepared to fit the whole structure of the lower-chord member is fixed on the lower formwork (730) to enclose the whole reinforcing cage (134).

Then, the concrete is placed into the lateral formwork (780) wherein the reinforcing cage (134) is enclosed, and said concrete is cured for a certain period. Explaining further, the characteristic compressive strength of concrete is not less than 40 MPa at 28 days, and steam curing is performed for the first day to protect cracking by the heat of hydration and to obtain the required strength early, and after then the lateral formwork (780) is removed and wet curing is performed for a certain period (about 7 days).

Figure 17F:
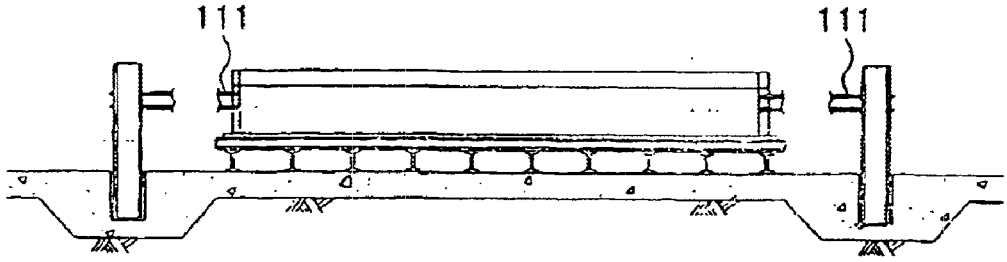
Figure 17G:
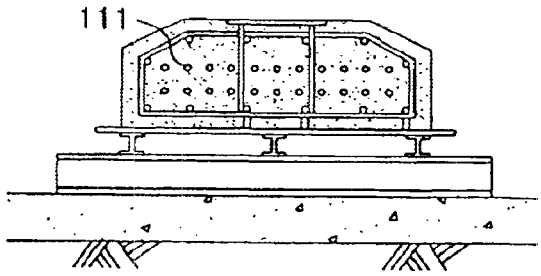
Figure 17H:
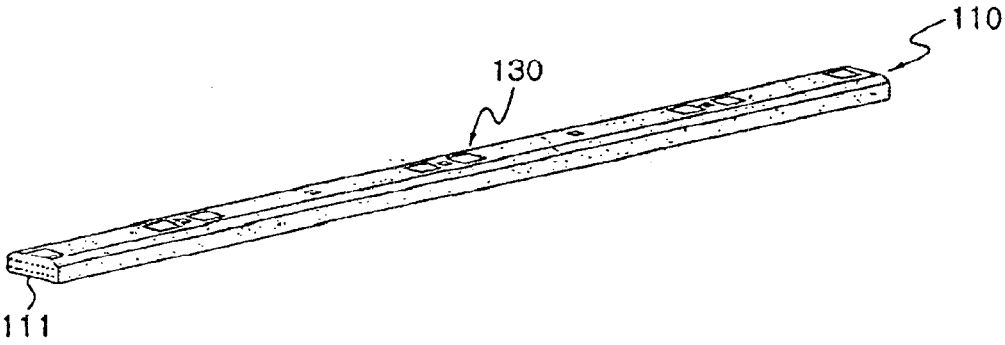

Subsequently, as shown at FIGS. 17*f* and 17*g*, when the curing of the concrete described above is completed, the tendons (111) are cut. Then, as shown at FIG. 17*h*, preparation of the lower-chord member (110) wherein the connecting unit (130) for the web member are exposed flatly on the upper face is finished. Here, at the moment when the tendons (111) are cut, a certain compressive force worked on to the axial direction of the concrete by being released of the tense state of the tendons (111) is provided to the lower-chord member (110). That is, the prestress could be introduced by transmitting the tension stored in the tendons (111) to the concrete by bonding between he tendons and the concrete.

Figure 17I:
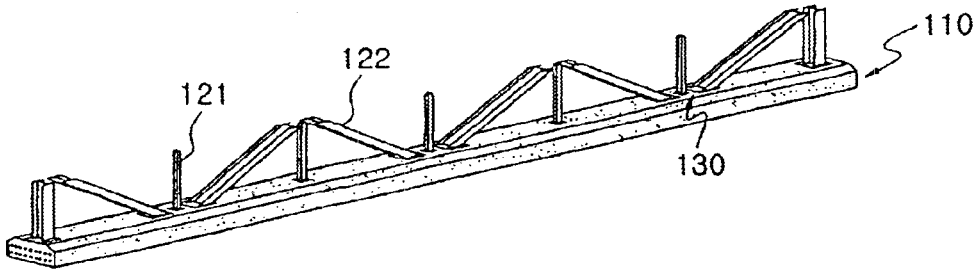

Next, as shown at FIG. 17*i*, the lower end of the vertical member (121) is vertically connected with the connecting unit (130) exposed on the upper face of the lower chord member (110) by welding or bolting.

Subsequently, after the diagonal members (122) are settled between the vertical members (121) diagonally, the lower end of the diagonal member (122) and the connecting unit (130) are connected by welding or bolting.

Figure 17J:
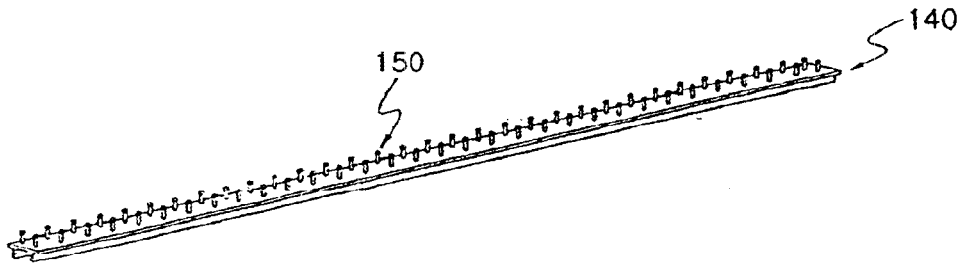

Next, as shown at FIG. 17*j*, after preparing the upper-chord member (140) having the same length as that of the lower-chord member (110: FIG. 17*i*) and a certain width, the shear connector (150) (usually studs (151)) is welded on the upper-chord member along the longitudinal direction with a certain distance.

Figure 17K:
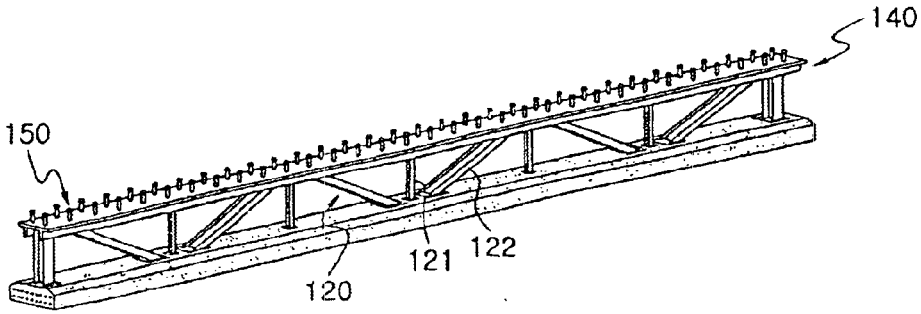

Subsequently, as shown at FIG. 17*k*, when the attachment of the shear connector (150) is finished, the upper-chord member (140) is connected with the vertical member (121) and the diagonal member (122) of the web member (120) by welding or bolting. Here, the planar stiffener (not drawn) is preferably attached at a certain position of the upper-chord member (140) connected with the web member (120). Explaining further, as shown at FIGS. 10*a* and 10*b*, it is preferable that said stiffener (160) is welded vertically on a certain position of the upper-chord member (140) connected with the web member (12) and on the upper end of the web member (120) by welding. In addition, as shown at FIG. 10*c* and 10*d*, said stiffener (160) could be connected vertically on a certain position of the upper-chord member (140)

connected with the web member (12) and on the upper end of the web member (120) by bolting.

Figure 17L:
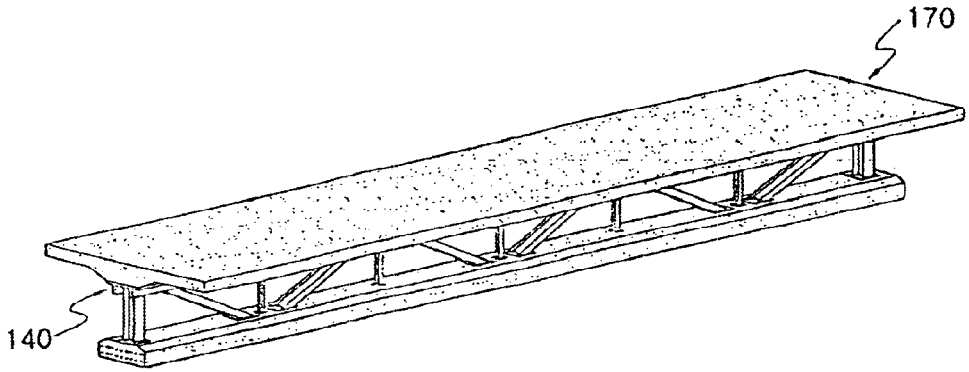

Finally, as shown at FIG. 17*l*, the concrete slab (170) is composed on the upper-chord member (140). Here, the concrete slab (170) is integrated with the upper-chord member (140) by the shear connector (150: FIG. 17*k*).

FIG. 18 is a flow chart to explain the construction method of a prestressed composite truss girder according to the $2^{nd}$ preferred embodiment of the present invention. The symbol explained at FIG. 16 represents the same process.

Referring to FIG. 18, the construction method of the prestressed composite truss girder according to the $2^{nd}$ preferred embodiment of the present invention is to introduce prestress to the concrete of the lower-chord member applying post-tensioning method on the contrary to the preparation process of the lower-chord member according to above-mentioned $1^{st}$ embodiment.

To achieve above object, the step of forming said lower-chord member (S100), as the same way in the process of above-mentioned $1^{st}$ embodiment, comprises the steps of (S121) establishing the concrete bed on the ground after smoothing the ground of a certain place, (S122) establishing the lower formwork in the linear form having a certain width and length on the H-beam after disposing a plurality of the H-beam in the lattice form on the concrete bed, (S123) establishing spacers between the reinforcing cage and the upper face of the lower formwork to separate the reinforcing cage at a certain interval from the upper face of the lower formwork after disposing the reinforcing cage wherein the vertical reinforcing bar and the transverse reinforcing bar are connected with and disposing the connecting unit at a certain interval along the longitudinal direction of the reinforcing cage. Thus, the explanation for the same process as that of above-mentioned $1^{st}$ embodiment will be abbreviated.

Then, the step of forming said lower-chord member (S100) comprises further steps of; (S124) disposing a plurality of the sheath tubes wherein anchorage devices are installed at the both ends; (S125) curing the concrete for a certain period after setting the lateral formwork to the lateral side of the reinforcing cage and pouring the concrete into the lateral formwork; and (S126) combining the concrete with the tendons by injecting the cement mortar through the inside of the sheath tube after the curing of the concrete is finished and a plurality of wire-type tendons are disposed in the inside of each sheath tube and then the tendons are tensioned using oil jack.

FIG. 19*a* to FIG. 19*h* is a brief cross-sectional schematic view to explain the construction method of the prestressed composite truss girder according to the $2^{nd}$ preferred embodiment of the present invention.

Figure 19A:
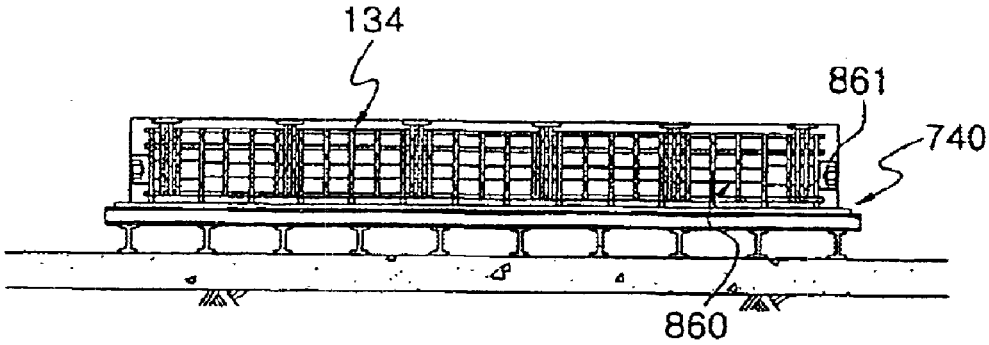
Figure 19B:
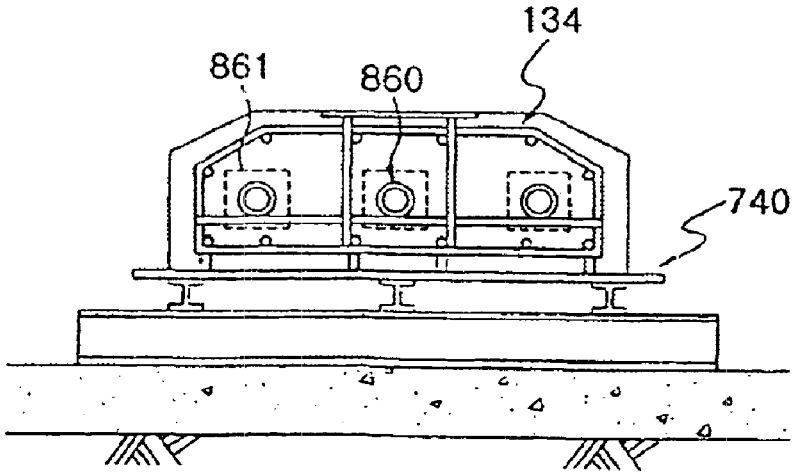

At first, as shown at FIG. 19*a* to FIG. 19*b*, like the same way as in above $1^{st}$ embodiment, the sheath tube (860) having the commercial anchorage device (861) at the both end is inserted into the reinforcing cage (134) while the reinforcing cage (134) is disposed on the linear lower formwork (740), then said anchorage device (861) is fixed solidly on the reinforcing cage (134).

Figure 19C:
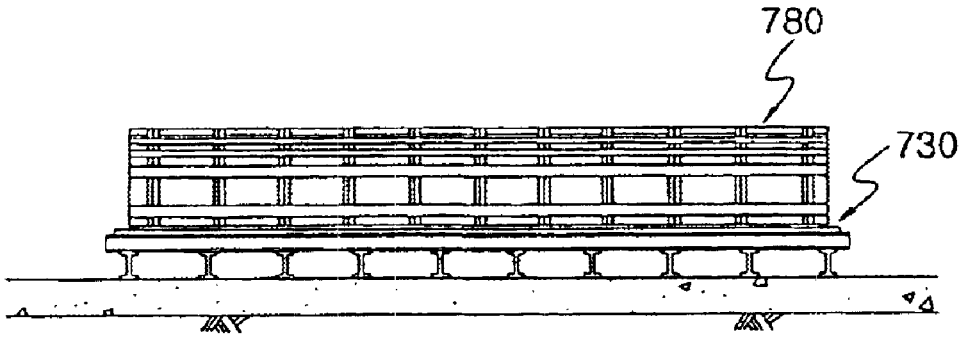
Figure 19D:
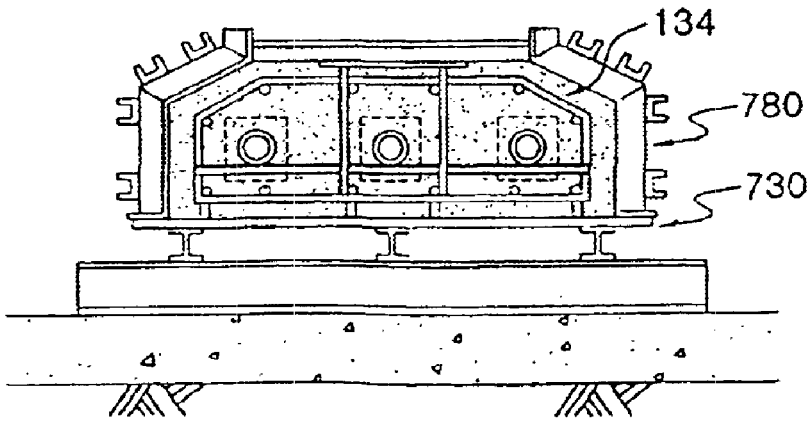

Subsequently, as shown at FIG. 19*c* to FIG. 19*d*, the lateral formwork (780) prepared to enclose the reinforcing cage (134) fitting the whole structure of the lower-chord member is fixed on the lower formwork (730).

Next, after pouring the concrete into the lateral formwork (780), the concrete is cured for a certain period according to the same way as in the $1^{st}$ embodiment.

Figure 19E:
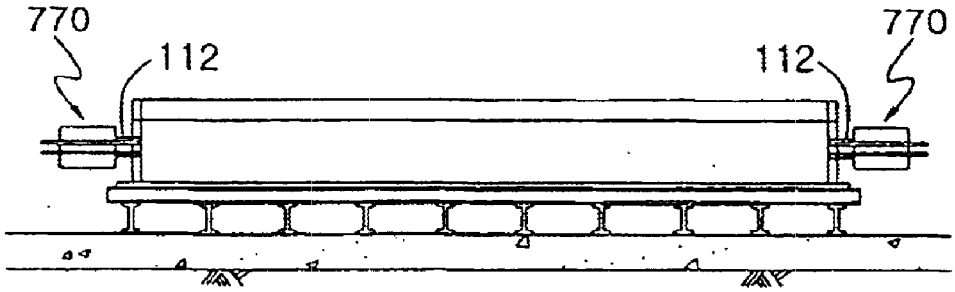
Figure 19F:
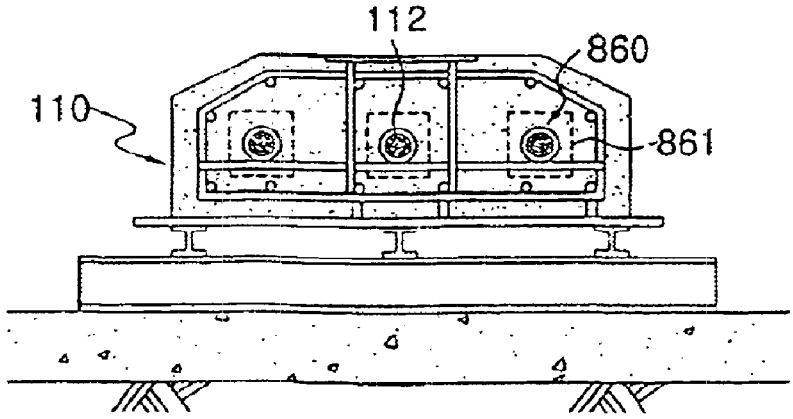

Then, as shown at FIG. 19*e* to FIG. 19*f*, when the curing of the concrete is finished, the tendons (112) are inserted into the sheath tube (860), and after stressing the tendons (112) using oil jack (770), said tendons (112) are settled to the anchorage device (861) using wedge (not drawn).

Next, certain amount of cement mortar is putted into the sheath tube (860) so that the tendons are attached with surrounding the concrete. Then, if the anchorage device is encased with the concrete, the preparation of the lower-chord member (110) is completed.

Figure 19G:
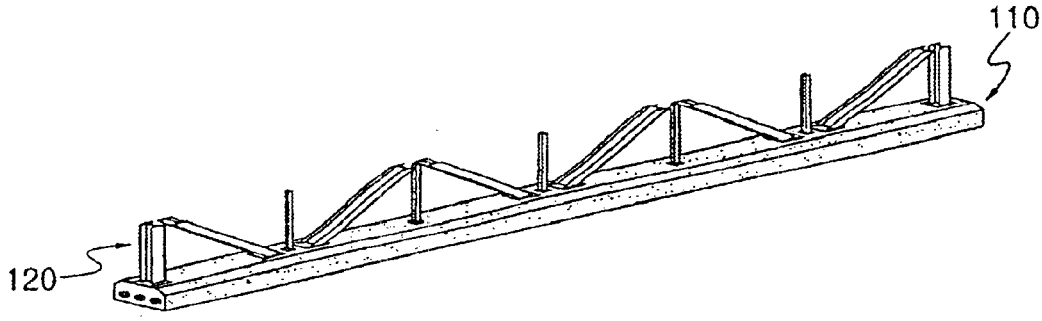
Figure 19H:
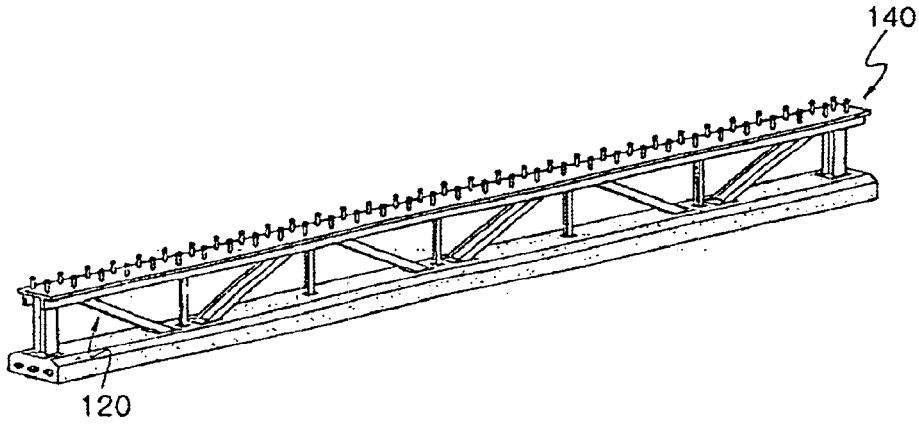

Finally, as shown at FIG. 19*g*, the web member (120) are connected on the upper face of the lower-chord member (110) (S200: FIG. 18), and as shown at FIG. 19*h*, the upper-chord member (140) is connected on the upper end of the web member (120) (S300: FIG. 18).

FIG. 20 is a flow chart to explain the construction method of a prestressed composite truss girder according to the $3^{rd}$ preferred embodiment of the present invention. The symbols explained at FIG. 16 and FIG. 18 represent the same process.

Referring to FIG. 20, the construction method of a prestressed composite truss girder according to the $3^{rd}$ preferred embodiment of the present invention is the same that of the preparation process of the lower-chord member wherein the post-tensioning method is applied as in above $2^{nd}$ embodiment, but there is difference in that after preparing the lower-chord member in the curved form on the plane of the concrete bed firstly (S131~S136), the lower-chord member is made to have curved shape of its cross-section by turning it 90°. The explanations for the same process as that of above-mentioned $1^{st}$ embodiment and $2^{nd}$ embodiment (S200, S300) will be abbreviated.

FIG. 21 is a brief perspective view to explain the construction method of the prestressed composite truss girder according to the $3^{rd}$ preferred embodiment of the present invention.

At first, as in above-described $2^{nd}$ embodiment, H-beam is disposed in the lattice form on the concrete bed (710), then, the lower-formwork having certain curved structure is established.

Next, after establishing the reinforcing cage, the connecting unit, the sheath tube and the lateral formwork successively, the concrete is injected into the inside of the lateral formwork and cured. Then, preparation of the lower-chord member (310) having certain curved structure is completed. Here, said lower-chord member (310) is laid on the concrete bed (710) for the lateral side being contacted with the concrete bed (710).

Finally, after the lower-chord member (310) is connected to the web-members (S200) and the web member are connected to the upper-chord member (S300), the truss girder according to the present invention is completed if the lower-chord member (310) is raised up by turning it 90° to the direction of the arrow as depicted at the figure.

While the present invention has been described in detail with reference to the preferred embodiments, those skilled in the art will appreciate that various modifications and substitutions can be made therein without departing from the spirit and scope of the present invention as set forth in the appended claims.

INDUSTRAIL APPLICABILITY

As described above in detail, the efficiencies of the prestressed composite truss girder and the construction method of the same according to the present invention are as follows.

First, because prestress is introduced to the axial direction of the lower-chord member, axial forces(not bending moments) is acted on the lower-chord member due to external loads including the dead load of the girder, so the present invention could effectively deal with tensile stress generated by the external loads.

Second, the efficiency of the material use could be maximized because the intensity of the prestress introduced to the lower-chord member could be easily increased up to the allowable compressive stress of the concrete.

Third, because the lower-chord member is composed of the concrete that has high resistance against compressive force, the present invention could effectively deal with the negative moment generated by the dead load or by the live load at the intermediate support of the continuous span. Therefore, the present invention could be effectively utilized at the composite girder having continuous span without additional reinforcing.

Fourth, because the web member have the open truss structure, the increment of the dead load according to the increase of the height of the girder is trivial. Then, if only the span length is lengthened at the condition of same load, the present invention could deal with the increment of the section force generated by the increase of the span length only by raising the height of the web member while remaining the cross-section of the upper-chord member and the lower-chord member constant.

Fifth, the present invention could extend the span length to 100 m based on the simply supported system because the prestress introduced to the lower chord member could be increased up to the allowable compressive stress if there is no height limitation of the girder.

Sixth, the present invention could maintain the depth/span ratio about 1/20 when the span length is 70 m, 1/25 when the span length is 50 m, and about 1/27 when the span length is not more than 40 m based on the road bridge. The stiffness of the girder is very high because both the slab and the lower chord member which are connected to the upper chord members are cracking-free state, and as a result the displacement due to live loads is remarkably decreased.

Seventh, it was known that the PSC composite girder is most economic when the span length is 30 to 40 m because the materials for the conventional girders are merely composed of concrete, iron, PS (prestressing steel), etc., and the high-quality structural steel is not used at all. But, the present invention could cut considerably the cost for the equipment required for manufacturing the girder though the material cost increases somewhat extent because the present invention uses structural steel for the upper-chord member and the web member. Because the height of the lower chord member is low and the cross-sectional shape is simple compared with the PSC girder, the required space for manufacturing and formwork is small, placement and compaction of the concrete is very simple, and assembling of the reinforcing bars and the PS steels is relatively easy.

Eighth, the present invention could remarkably reduce the cost for the equipment to move, and to settle the girder because it weigh light, and the present invention shows excellent stability against overturn because the center of the girder is placed at low position, and shows excellent economic efficiency because the term of works to manufacture the girder could be remarkably shortened.

Ninth, contrary to the conventional composite girder having unified solid cross-sectional structure, the present invention make it possible to manufacture-the shape of the girder to fit a desired curve because the upper-chord member and the lower-chord member which are easily cast are manufactured to fit a desired curve, then the web member composed of rolled steel are prepared in a straight manner and combined them by welding or bolting.

Tenth, the present invention represents 30% of cost reduction to construct a certain structure because the shape of the girder could be easily manufactured to fit a certain curve contrary to the conventional curved structure or curved bridge wherein relatively expensive steel box composite girder is applied.

What is claimed is:

1. A prestressed composite truss girder having a truss structure whereon a slab concrete is composed comprises:

a lower-chord member composed of prestressed concrete wherein prestress is introduced to resist against tensile stress and to reduce the displacement generated by external loads and having perpendicular and horizontal cross-section of certain shape and certain length;

web member wherein vertical members and diagonal members composed of a steel beam to resist against the shear stress applied on the composite girder are connected alternately with the upper face of said lower-chord member; and upper-chord member composed of a steel plate connected with said web member along the longitudinal direction of said lower-chord member to resist against the compressive force generated before said concrete slab is composed, wherein said lower-chord member comprises a plurality of wire-type strands or tendons placed inside the lower-chord member in the longitudinal direction to introduce the prestress to a certain distribution along the lower-chord member.

2. The prestressed composite truss girder according to claim 1, wherein said wire-type strands or tendons have different cross-sectional area along the lower-chord member to vary amount of the introduced presetress at the cross section of said lower-chord member in longitudinal direction.

3. A construction method of a prestressed composite truss girder comprises steps of:

(a) forming a prestressed concrete lower chord member having certain length, wherein certain prestress is introduced to the axial direction;

(b) connecting alternately the vertical members and the diagonal members composed of structural rolled steel having certain length on the upper face of said lower-chord member; and (c) connecting a planar upper chord member with said vertical members and diagonal members along the longitudinal direction of said lower chord member.

4. The construction method of a prestressed composite truss girder according to claim 3, wherein said (a) step comprises steps of:

(a1) establishing the concrete bed on the ground after smoothing the ground of a certain place;

(b1) establishing the lower formwork in the linear form having a certain width and length on the H-beam after disposing a plurality of the H-beams in the lattice form on said concrete bed;

(c1) establishing spacers between the reinforcing cage and the upper face of the lower formwork to separate the reinforcing cage at a certain interval from the upper face of the lower formwork after placing the reinforcing cage and the connecting unit for the web member at a certain interval along the longitudinal direction of the reinforcing cage;

(d1) anchoring the tendons to the abutments to maintain the tendons at the tense state after inserting and placing a plurality of the wire-type tendons into the reinforcing cage and establishing the abutments at the position separated to a certain interval from the both ends of the lower-formwork and then introducing certain tension to the tendons using oil jack;

(e1) curing the concrete for a certain period after setting the lateral formwork at the lateral side of the reinforcing cage and pouring the concrete into the lateral formwork; and (f1) cutting the tendons from the abutments to introduce a certain prestress to the cured concrete.

5. The construction method of a prestressed composite truss girder according to claim 3, wherein said (a) step comprises steps of:

(a2) establishing the concrete bed on the ground after smoothing the ground of a certain place;

(b2) establishing the lower formwork in the linear form having a certain width and length on the H-beam after disposing a plurality of the H-beam in the lattice form on the concrete bed;

(c2) establishing spacers between the reinforcing cage and the upper face of the lower formwork to separate the reinforcing cage at a certain interval from the upper face of the lower formwork after placing the reinforcing cage and the connecting unit for the web member at a certain interval along the longitudinal direction of the reinforcing cage;

(d2) placing a plurality of the sheath tubes wherein anchorage devices are installed at the both ends;

(e2) curing the concrete for a certain period after setting the lateral formwork to the lateral side of the reinforcing cage and pouring the concrete into the lateral formwork; and (f2) bonding the tendons with surrounding concrete by injecting the cement mortar through the inside of the sheath tube after the curing of the concrete is finished and a plurality of wire-type tendons are placed in the inside of each sheath tube and then the tendons are tensioned using oil jack.

* * * * *